US007180357B2

(12) United States Patent
Van Tuijl

(10) Patent No.: US 7,180,357 B2
(45) Date of Patent: Feb. 20, 2007

(54) OPERATIONAL AMPLIFIER INTEGRATOR

(75) Inventor: Adrianus Johannes Maria Van Tuijl, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 24 days.

(21) Appl. No.: 10/511,801

(22) PCT Filed: Apr. 1, 2003

(86) PCT No.: PCT/IB03/01278

§ 371 (c)(1),
(2), (4) Date: Oct. 19, 2004

(87) PCT Pub. No.: WO03/091933

PCT Pub. Date: Nov. 6, 2003

(65) Prior Publication Data

US 2005/0218961 A1 Oct. 6, 2005

(30) Foreign Application Priority Data

Apr. 23, 2002 (EP) ..... 02076619

(51) Int. Cl.
*G06G 7/19* (2006.01)

(52) U.S. Cl. ..... 327/345; 327/336

(58) Field of Classification Search ..... 327/336, 327/337, 344, 345

See application file for complete search history.

(56) References Cited

U.S. PATENT DOCUMENTS 5,105,163 A * 4/1992 Voorman ..... 330/107
5,539,354 A * 7/1996 Carsten ..... 327/559

* cited by examiner

*Primary Examiner*—Kenneth B. Wells

(57) ABSTRACT

An integrator circuit comprises an operational amplifier which has a transistor stage (1) with an input terminal (4) and an output terminal(3), a feedback capacitor (2) connected between the input terminal (4) and the output terminal (3), and a resistor (5) connected to the input terminal (4), and also has an additional circuit branch (20) comprising a second capacitor (22) and a second resistor (25) connected in series one with the other and connected between the output terminal (3) of the transistor stage (1) and voltage comprising the inverted input voltage to the integrator circuit. Preferably two additional circuit branches (320, 320') are provided. One may be connected between the non-inverting or positive output terminal (33) of the transistor stage (1) and the inverting or negative input of the integrator. The other circuit may be connected between the negative output terminal (37) of the transistor stage (1) and the positive input of the integrator. This is particularly useful for balanced amplifier topology. The invention finds particular application in the first filter stage (integrator) in a sigma delta analog to digital conversion circuits and provide an improved operational amplifier integrator and particularly helps in compensating for a right halfplane zero.

6 Claims, 3 Drawing Sheets

$$I_2 = \frac{V_{out} - V_{in}}{1/sC + R} \qquad \text{Equation 1}$$

$$I_1 = g_m V_+ = \frac{g_m V_{in}/sC + g_m V_{out} R}{1/sC + R} \qquad \text{Equation 2}$$

$$V_+ = \frac{V_{in}/sC + V_{out} R}{1/sC + R} \qquad \text{Equation 3}$$

$$I_1 + I_2 = 0 \qquad \text{Equation 4}$$

$$\Rightarrow V_{out} - V_{in} + g_m V_{in}/sC + g_m V_{out} R = 0 \qquad \text{Equation 5}$$

$$\Rightarrow \frac{V_{out}}{V_{in}} = -\frac{1 - sC/g_m}{s(1/g_m + R)C} \qquad \text{Equation 6}$$

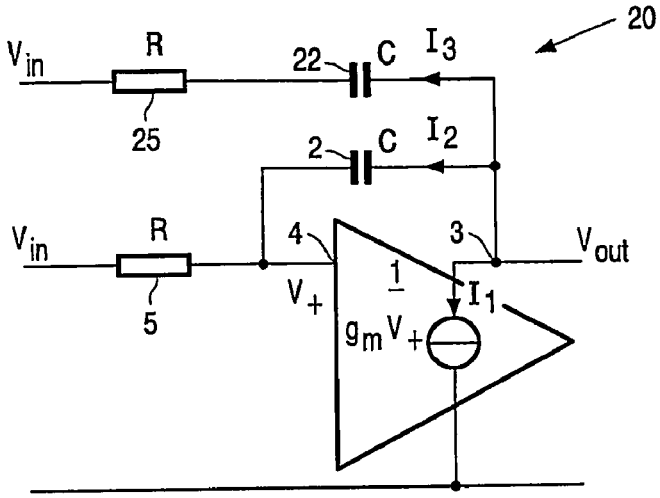

FIG. 2

$$I_2 = \frac{V_{out} - V_{in}}{1/sC + R} \qquad \text{Equation 7}$$

$$I_3 = \frac{V_{out} + V_{in}}{1/sC + R} \qquad \text{Equation 8}$$

$$I_2 + I_3 = \frac{2V_{out}}{1/sC + R} \qquad \text{Equation 9}$$

$$V_+ = \frac{V_{in}/sC + V_{out}R}{1/sC + R} \qquad \text{Equation 10}$$

$$\Rightarrow I_1 = \frac{g_m V_{in}/sC + g_m V_{out} R}{1/sC + R} \qquad \text{Equation 11}$$

$$I_1 + I_2 + I_3 = 0 \qquad \text{Equation 12}$$

$$g_m V_{in}/sC + g_m V_{out} R + 2V_{out} = 0 \qquad \text{Equation 13}$$

$$\frac{V_{out}}{V_{in}} = -\frac{1}{s(2/g_m + R)C} \qquad \text{Equation 14}$$

FIG. 6

OPERATIONAL AMPLIFIER INTEGRATOR

The present invention relates to an operational amplifier (op amp) integrator.

It is known to construct integrator circuits from op amps by connecting a resistor to the input of a transistor circuit and using a capacitor as a feedback element. The ideal integrator has infinite gain and only a single pole when the frequency of the applied signal is zero. However, practical integrator circuits based on a transconductance stage have a zero in the right halfplane when the frequency of the applied signal is equal to the feedback capacitance divided by the transconductance of the transistor.

It is an object of the present invention to provide an improved operational amplifier integrator and particularly to compensate for the right halfplane zero.

According to the present invention there is provided an integrator circuit comprising:

a transistors stage a feedback capacitor connected between the input and the output of the transistor stage;

a resistor connected to the input of the transistor stage;

characterised by an additional circuit branch comprising:

a second capacitor and a second resistor connected in series one with the other and connected between the output of the transistor stage and the inverted input to the integrator circuit.

Preferably two additional circuit branches are provided: one may be connected between the positive input and output of the transistor stage and one connected between the negative input and output. This is particularly useful for balanced amplifier topology. The transistor is an invertor and thus positive input voltages provide negative output voltages and vice versa.

The invention finds particular application in the first filter stage (integrator) in a sigma delta analog to digital conversion circuit. This first filter stage is very hard to design.

For a better understanding of the present invention and to show how the same may be carried into effect, reference will now be made to the accompanying drawings, in which:

FIG. 2 is a circuit diagram of one embodiment of an op amp integrator according to the present invention;

FIG. 6 is a series of equations which apply to the circuit of the invention as shown in FIG. 2.

Figures 1, 5:
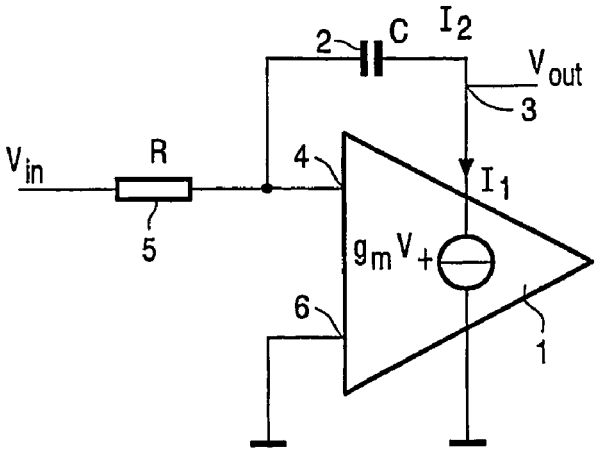
FIG. 1 PRIOR ART
FIG. 1 is a circuit diagram of a conventional op amp integrator.
FIG. 5 is a series of equations which apply to the known circuit of FIG. 1.

In FIG. 1 a prior art op amp integrator circuit (transconductance stage) is shown comprising, as is well known to a person skilled in the art, a transistor stage 1 having a tranconductance $g_m$ and an internal voltage $V_+$. A feedback capacitor 2 of value C is connected between a inverting output terminal 3 of the transistor and its non-inverting input terminal 4. A resistor 5 of value R is also connected to the non-inverting input terminal 4 to buffer the input voltage $V_{in}$. The inverting input terminal 6 is connected to ground. The voltage at the non-inverting output 3 of the transistor stage 1 is $V_{out}$.

The current to the feedback capacitor 2 is $I_2$ and this is given by the voltage across the capacitor 2 divided by the total impedence presented by the capacitor 2 and the resistor 5, and is given by equation 1 in FIG. 5. The current flowing through the transistor 1 to ground is $I_1$ as indicated and this is given by the voltage $V_+$ through the transistor stage 1 multiplied by its transconductance $g_m$, as shown by equation 2 in FIG. 5. The internal voltage $V_+$ of transistor stage 1 is given by equation 3.

Since the total current must be preserved in the circuit then the sum of the currents $I_2$ and $I_1$ must be zero, as indicated in equation 4. Thus, substituting equations 1 and 2 in equation 4 results in equation 5. The terms are rearranged in equation 6 showing that there is a zero in the right half plane. This is undesirable.

This zero can be compensated by the extra circuit branch which will be evident from a comparison of the known circuit of FIG. 1 with the new circuit of FIG. 2. The extra circuit branch 20 has a current $I_3$ and comprises a second capacitor 22 and a second resistor 25 connected in series between an inverted input voltage $-V_{in}$ and the non-inverting output node 3 of the transistor stage 1.

The equations 7 to 13 in FIG. 6 illustrate how the extra circuit branch 20 compensates for the zero in the right half plane.

Equation 7 is the same as Equation 1 in FIG. 5 and gives the value of the current $I_2$ in the feedback branch comprising capacitor 2. Equation 8 gives the current $I_3$ in the xtra circuit branch 20, and equation 9 sums these two currents.

In equation 10 the formula for the internal voltage $V_+$ in the transistor stage 1 is set out and this leads to equation 11, giving the current $I_1$ through the transistor stage 1.

Equation 12 assumes that the current in the three branches must cancel out, ie that the three currents add up to zero, and equation 13 then effectively sums the currents $I_1$, $I_2$ and $I_3$ given by equations 11, 7 and 8 respectively.

In equation 14 the terms are simplified to give an equation for the ratio of the output voltage to the input voltage. As can be seen from a comparison of equation 14 giving this ratio for the new circuit of FIG. 2, with the equation 6 giving the ratio for the known circuit of FIG. 1, the new circuit compensates for the zero in the right halfplane, and this compensation is not dependent on the characteristic of the amplifier.

Figure 3:
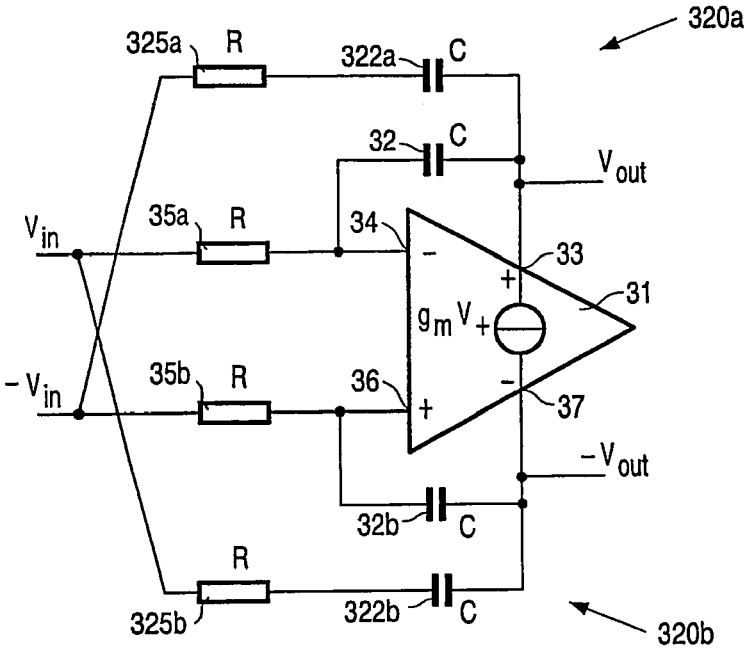
FIG. 3 is a circuit diagram of a second embodiment of an op amp integrator according to the present invention using balanced amplifier topology.

FIG. 3 illustrates an op amp integrator using balanced amplifier topology, which is well known to persons skilled in the art. The bias amplifier is a transconductance so that a positive input voltage leads to a current sink at the output and hence a negative voltage at the output. The circuit is essentially the same as that in FIG. 2 but the circuit elements are repeated on the other side of the transistor stage 31 essentially in mirror image. Thus a first input voltage $V_{in}$ is connected via a first input resistor 35*a* to a first input terminal 34 of transistor stage 31. A first feedback capacitor 32*a* is connected between the first input terminal 34 and a first output terminal 33 at which a first output voltage $V_{out}$ appears.

An negative input voltage $-V_{in}$ is connected via a second input resistor 35*b* to a second input terminal 36 of transistor stage 31. A second feedback capacitor 32*b* is connected between the second input terminal 36 and the second output terminal 37 at which a negative output voltage $-V_{out}$ appears.

Two extra circuit branches, each comprising a capacitor and a resistor in series, are provided. A first extra circuit branch 320*a* comprises a capacitor 322*a* and a resistor 325*a*. This connects the negative input voltage $-V_{in}$ to the first output terminal 33 at which the positive output voltage $V_{out}$ appears. A second extra circuit branch 320*b* comprises a capacitor 322*b* and a resistor 325*b*. This connects the positive input voltage $V_{in}$ to the output terminal 37 at which the negative output voltage $-V_{out}$ appears.

Figure 4:
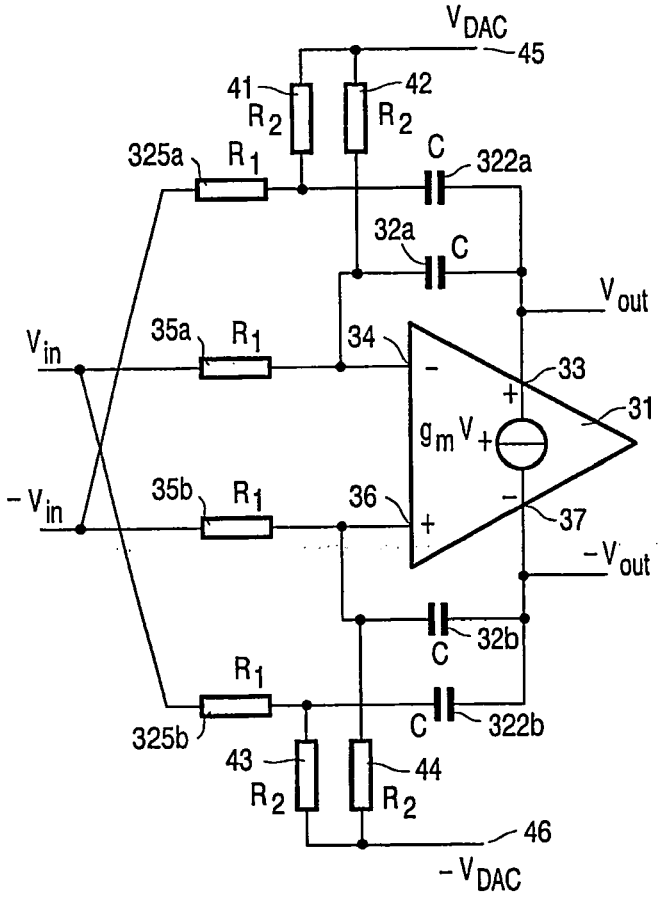
FIG. 4 is a circuit diagram of a third embodiment of an op amp integrator according to the present invention applied to a sigma delta analog to digital convertor circuit.

In FIG. 4 a circuit diagram is presented wherein the invention is applied to the first stage of a sigma delta analog to digital convertor. This circuit comprises the circuit elements shown in FIG. 3 and denoted by the same reference symbols and some additional resistors and output voltage lines. The additional resistors have a different value R2 to the resistors R1 shown in the previous figures. Each is connected between respective resistors R1 and capacitors C and an additional output voltage line. Thus resistor 41 connects resistor 325*a* to analog output voltage line 45 on which the positive analog voltage $V_{DAC}$ appears. Resistor 42 connects input terminal 34 of transistor stage 31 to output line 45 ($V_{DAC}$).

Likewise resistor 43 connects resistor 325*b* to analog output voltage line 46 on which a negative analog voltage $-V_{DAC}$ appears. Resistor 44 connects input terminal 36 of transistor stage 31 to the inverting analog output line 46 ($-V_{DAC}$).

What is claimed is:

1. An integrator circuit comprising: an operational amplifier having: a transistor stage having an input terminal and an output terminal; a feedback capacitor connected directly between the input terminal and the output terminal of the transistor stage; a resistor connected between an input voltage to the integrator circuit and the input terminal of the transistor stage; further comprising a first additional circuit branch comprising: a second capacitor and a second resistor connected in series directly to each other further wherein the second capacitor is directly connected to the output terminal of the transistor stage and the second resistor is directly connected to a voltage comprising the inverted input voltage to the integrator circuit.

2. An integrator circuit according to claim 1 further comprising a second additional circuit branch.

3. An integrator circuit according to claim 2 wherein the first additional circuit branch is connected between the non-inverted output of the transistor stage and the inverted input of the integrator and the second additional circuit branch is connected between the inverted output terminal of the transistor stage and the non-inverted input of the integrator.

4. A sigma delta analog to digital conversion circuit comprising an integrator circuit according to claim 1.

5. A first filter stage in a sigma delta analog to digital conversion circuit comprising an integrator circuit comprising:

an operational amplifier having:

a transistor stage having an input terminal and an output terminal;

a feedback capacitor connected directly between the input terminal and the output terminal of the transistor stage;

a resistor connected between an input voltage to the integrator circuit and the input terminal of the transistor stage; further comprising a first additional circuit branch comprising:

a second capacitor and a second resistor connected in series directly to each other further wherein the second capacitor is directly connected to the output terminal of the transistor stage and the second resistor is directly connected to a voltage comprising the inverted input voltage to the integrator circuit.

6. A balanced amplifier comprising an integrator circuit comprising:

an operational amplifier having:

a transistor stage having an input terminal and an output terminal;

a feedback capacitor directly connected between the input terminal and the output terminal of the transistor stage;

a resistor connected between an input voltage to the integrator circuit and the input terminal of the transistor stage; further comprising a first additional circuit branch comprising:

a second capacitor and a second resistor connected in series directly to each other further wherein the second capacitor is directly connected to the output terminal of the transistor stage and the second resistor is directly connected to a voltage comprising the inverted input voltage to the integrator circuit.

* * * * *